US011608614B2

(12) United States Patent
Massey

(10) Patent No.: US 11,608,614 B2
(45) Date of Patent: Mar. 21, 2023

(54) LOADING MACHINE WITH SELECTABLE PERFORMANCE MODES

(71) Applicant: Caterpillar Inc., Peoria, IL (US)

(72) Inventor: Andrew James Massey, Holly Springs, NC (US)

(73) Assignee: Caterpillar Inc., Peoria, IL (US)

( * ) Notice: Subject to any disclaimer, the term of this patent is extended or adjusted under 35 U.S.C. 154(b) by 176 days.

(21) Appl. No.: 17/132,533

(22) Filed: Dec. 23, 2020

(65) Prior Publication Data

US 2022/0195701 A1 Jun. 23, 2022

(51) Int. Cl.
*E02F 9/22* (2006.01)
*E02F 9/20* (2006.01)

(52) U.S. Cl.
CPC ..... *E02F 9/2253* (2013.01); *E02F 9/2033* (2013.01); *E02F 9/2278* (2013.01)

(58) Field of Classification Search
CPC ..... E02F 9/2253
See application file for complete search history.

(56) References Cited

U.S. PATENT DOCUMENTS

| | | | | |
|---|---|---|---|---|
| 6,856,878 | B2 | 2/2005 | Braunhardt et al. | |
| 8,777,622 | B2 | 7/2014 | Rauch | |
| 9,441,348 | B1 | 9/2016 | Alig et al. | |
| 10,056,009 | B2 | 8/2018 | Smith et al. | |
| 2008/0199294 | A1* | 8/2008 | Sahlin | E02F 3/847 701/50 |
| 2008/0234902 | A1* | 9/2008 | Johnson | E02F 9/2029 701/50 |
| 2014/0330490 | A1 | 11/2014 | Aoki et al. | |
| 2015/0004572 | A1* | 1/2015 | Bomer | G09B 9/042 434/219 |
| 2015/0004573 | A1 | 1/2015 | Bomer et al. | |
| 2015/0139767 | A1* | 5/2015 | Moriki | E02F 3/431 414/699 |
| 2016/0017571 | A1* | 1/2016 | Paull | E02F 9/2228 701/50 |
| 2017/0114525 | A1* | 4/2017 | Rosa Neto | E02F 9/0883 |
| 2017/0247860 | A1* | 8/2017 | Lehtinen | E02F 9/2029 |

(Continued)

FOREIGN PATENT DOCUMENTS

| | | | |
|---|---|---|---|
| EP | 3660226 | A1 | 6/2020 |
| KR | 20140061004 | A | 5/2014 |
| WO | 2020045577 | W | 3/2020 |

OTHER PUBLICATIONS

Written Opinion and International Search Report for Int'l. Patent Appln. No. PCT/US2021/059664, dated Mar. 24, 2022 (13 pgs).

*Primary Examiner* — Thomas E Lazo
(74) *Attorney, Agent, or Firm* — Leydig, Voit & Mayer, Ltd

(57) ABSTRACT

A loading machine for loading, hauling, and dumping material about a worksite includes a lifting implement pivotally joined to a machine frame to articulate with respect to a work surface. A lift sensor is operatively configured to measure vertical articulation of the lifting mechanism. An electronic controller communicating with the lift sensor can be programmed to operate the loading machine in one of a rated performance mode and a limited performance mode depending upon the vertical articulation of the lifting implement with respect to the work surface.

16 Claims, 6 Drawing Sheets

(56) References Cited

U.S. PATENT DOCUMENTS

| | | | | |
|---|---|---|---|---|
| 2019/0211529 | A1* | 7/2019 | Vigholm | E02F 9/2253 |
| 2019/0226179 | A1* | 7/2019 | Uno | E02F 9/0841 |
| 2020/0248436 | A1 | 8/2020 | Hyodo | |
| 2020/0299923 | A1* | 9/2020 | Enomoto | E02F 3/431 |

* cited by examiner

LOADING MACHINE WITH SELECTABLE PERFORMANCE MODES

TECHNICAL FIELD

This patent disclosure relates generally to a loading machine for loading material and moving material about a worksite and, more particularly, to a loading machine having different and selectable modes or levels of operational capabilities or performance characteristics.

BACKGROUND

Loading and/or hauling machines are commonly used at worksites such as mines, quarries, and construction sites to move materials to different locations within and/or away from the worksite. Examples of loading machines include bucket or wheel loaders, dozers, excavators, dump trucks and the like. Loading machines typically include a movable work tool such as a bucket or dump body for accommodating the material that is coupled to an articulating lifting mechanism such as a mechanical linkage that is movable through various positions and spatial configurations. An operator of the loading machine can control various input devices to conduct a sequence of operations to maneuver the work tool and lifting mechanism and complete an operation. For example, one common task for a loading machine is to load a bucket with material, lift the material with respect to the ground or work surface, transport the material about the worksite, and unload or dump the material to a material receptacle such as a haul truck or into the hopper of material processing equipment.

The loading, hauling, and dumping operation is a relatively complex task involving several distinct steps and sub-operations that require the operator be sufficiently trained to conduct efficiently and safely. In addition, in a mining environment or large scale construction site, the large sizes and forces associated with the machines and the materials they are moving may mean that errors or mistakes can lead to malfunctions or damage to the equipment. In addition, in recent years, there have been suggestions and efforts to enable remote operation or partially automate the operation of loading machines through the application of computers and controls systems. However, because the operator may be removed from directly controlling the loading machine under such conditions, the sensation or experience that is otherwise available to the operator to guide operation of the loading machine may be diminished.

U.S. Pat. No. 9,441,348 ("the '348 patent"), assigned to the assignee of the present application, describes a material handling machine equipped with a system that assists in training operators in operation of the machine. Based on various inputs and sensor data, the system can resolve or determine the skill level of a particular operator with respect to operation of the machine. If the operator is relatively inexperienced, the system can adjust certain operational aspects of the machine including, for example, aspects of a hydraulic system associated with a lifting implement to accommodate the relevant experience level. The present disclosure is directed to similar but novel improvements regarding adjusting performance characteristics of a loading and hauling machine.

SUMMARY

The disclosure describes, in one aspect, a loading machine comprising: loading machine having a machine frame supported on a plurality of propulsion components for travel over a work surface. To power the propulsion components, the loading machine includes a power source operatively coupled to the plurality of propulsion components through a drivetrain to propel the loading machine. The power source and drivetrain are selectively adjustable to change a travel velocity of the loading machine over the work surface. The loading machine include a lifting mechanism articulately coupled to the machine frame and operative associated with a lift actuator to articulate the lifting mechanism with respect to the machine frame. A lift sensor is included to sense vertical articulation of the lifting mechanism with respect to the work surface. To control operation of the loading machine, a performance selection input may be used to select between a rated performance mode and a limited performance mode. The loading machine also includes an electronic controller operatively associated with the power source and drivetrain and in electronic communication with the lift sensor. The electronic controller is programmed to execute the limited performance mode and limit the travel speed of the loading machine in dependence on vertical articulation of the lifting implement with respect to the work surface.

In another aspect, the disclosure describes a method of operation a loading machine. According to the method, a performance selection input is received that enables selection between a rated performance mode and a limited performance mode. The method utilizes a lift sensor to sense vertical articulation of a lifting implement with respect to a work surface. In the limited performance mode, the method limits a manufacturer rate performance characteristic of the loading machine in dependence on vertical articulation of the lifting implement with respect to the work surface in the limited performance mode. In the rated performance mode, the method does not limit the manufacturer-rated performance characteristic.

In yet another aspect, the disclosure describes a performance management system for selecting performance modes for operation of a loading machine. The performance management system includes or is associated with a lift sensor operatively configured to sense vertical articulation of a lifting mechanism with respect to a work surface. The performance management system is also associated with a drivetrain configured to transmit power from a power source to a propulsion component to propel the loading machine over the work surface. The performance management system is partially embodied in an electronic controller that communicates with the lift sensor and is coupled to the drive train. In accordance with the performance management system, the electronic controller can adjust operation of the drivetrain to limit the available travel velocity of the wheel loader in dependence upon on vertical articulation of the lifting implement with respect to the work surface.

DETAILED DESCRIPTION

Figure 1:
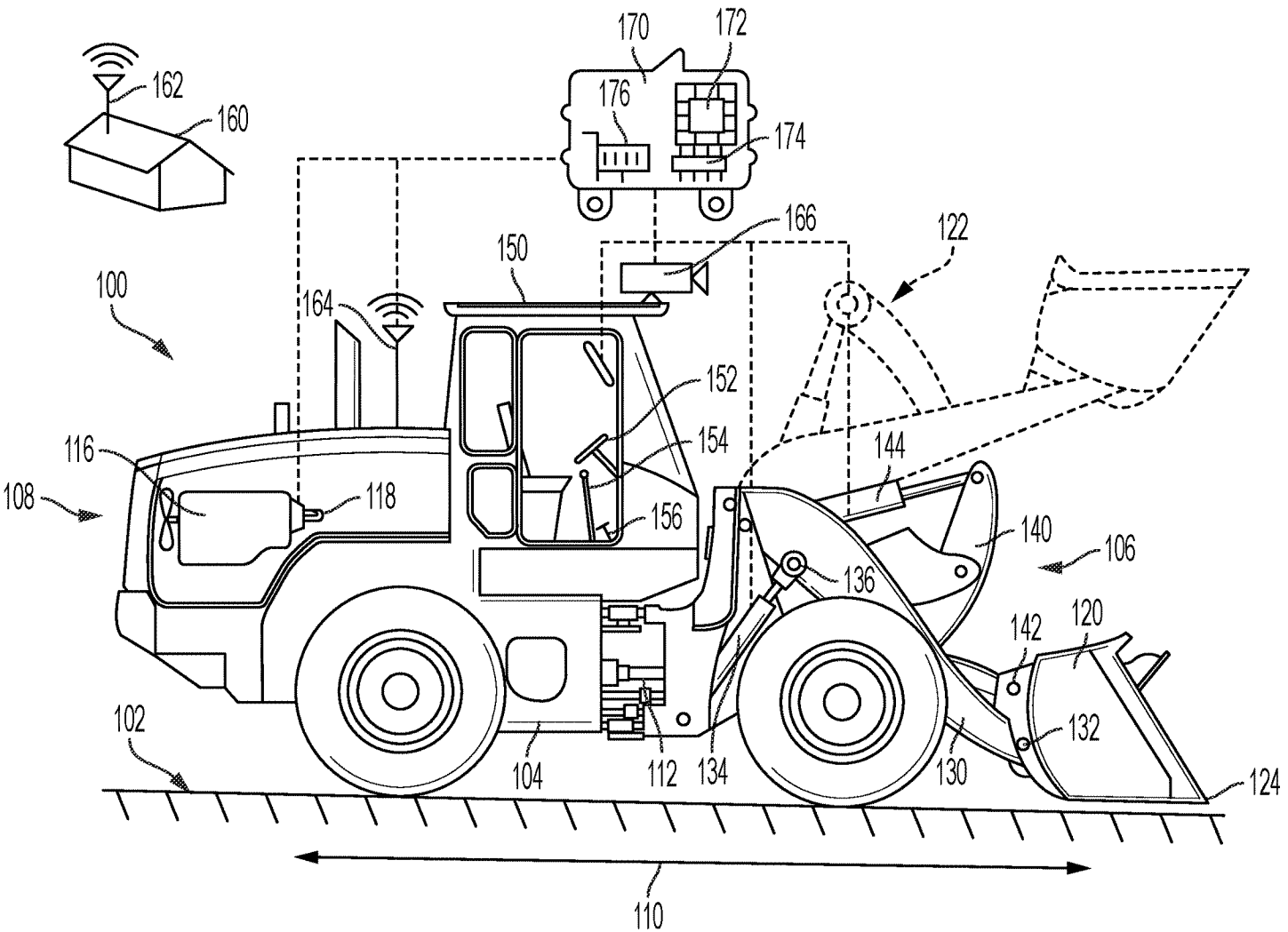
FIG. 1 is a side elevation view of a loading machine in the embodiment of a wheel loader for moving materials about a worksite designed in accordance with the disclosure.

Now referring to the drawings, wherein whenever possible like reference numbers will refer to like elements, there is illustrated in FIG. 1 a mobile loading machine in the particular embodiment of a wheel loader 100 for loading, transporting, and delivering material about a work surface 102 associated with a worksite. However, while the present disclosure focuses on a loading machine in the embodiment of a wheel loader 100 aspects of the disclosure may be applicable to other types of machines such as a dozer, an excavator, a dump truck, and the like. Such machines typically include a work tool like a bucket or blade to interact with and accommodate material as the machine moves about the worksite. Examples of materials hauled about the worksite include but are not limited to coal, ore, minerals, construction aggregate, overburden, other earthen materials, and the like. Furthermore, in addition to loading and hauling earthen materials, aspects of the disclosure may be applicable to machines used in other industries such as cargo transportation, construction, agriculture, and the like.

The wheel loader 100 can include a machine frame 104 that may be oriented with a forward end 106 and a rearward end 108 that are aligned along a travel axis 110 of the machine; however, because the wheel loader 100 may operate in both forward and reverse directions, the designations are used herein primarily for reference purposes. To facilitate maneuverability such as making sharp turns, the machine frame 104 may be an articulated frame wherein the forward end 106 and the rearward end 108 are pivotally joined at an articulated joint 112. To enable the wheel loader 100 move about the work surface 102 in a mobile manner, the machine frame 100 can be supported on a plurality of propulsion components 114 such as rotatable wheels that can include rubber pneumatic tires. The wheels may be designated as powered drive wheels to propel the wheel loader 100, steerable wheels to adjust direction of the wheel loader, or combinations thereof. Other suitable embodiments of loading machines may include different propulsion components 114 such as continuous tracks that include a closed belt disposed about rollers and/or sprockets, whereby translation of the belt carries the hauling machine over the work surface 102.

To generate power for the propulsion components 114 and the other systems associated with the wheel loader 100, a power source such as an internal combustion engine 116 can be disposed on the machine frame 104. The internal combustion engine 116 can burn any suitable hydrocarbon-based fuel and may be a diesel compression ignition engine, a spark ignited gasoline engine, or a natural gas or dual fuel engine. Such internal combustion engines 116 convert through combustion the latent chemical energy in the hydrocarbon-based fuel to a mechanical motive force in the form of rotary motion that can be harnessed for other useful work. The rotary output of the engine 116 can be transmitted through a crankshaft 118 extending from the engine and operatively coupled to the propulsion components 114 and other systems. In other embodiments, the power source may utilize electricity supplied from, for example, rechargeable batteries or may be a hybrid power source powered by an internal combustion engine and operatively associated with a regenerative electric motor.

To accommodate material during operation, the wheel loader 100 can include a work tool in the embodiment of a bucket 120 operatively associated with a lifting mechanism 122 that can vertically raise and lower the bucket with respect to the work surface 102. The lifting mechanism 122 can be a mechanical linkage assembled from a plurality of rigid links connected by pivotal joints that can articulate and move with respect to each other to controllably displace or reposition the bucket 120. In particular, the bucket 120 can be pivotally disposed at the distal end of the lifting mechanism 122 which in turn may be pivotally connected to the forward end 106 of the machine frame 104. To receive material, the bucket 120 can be formed as an opened trough including a leading edge or blade 124 that can displace and direct material into the bucket when lowered proximate to the work surface 102. In other embodiments of mobile loading machines, it will be appreciated that the work tool may be different than a bucket such as, for example, a fork, a blade, a drilling auger, and the like.

To vertically raise and lower the bucket 120 with respect to the work surface 102, the mechanical linkage forming the lifting mechanism 122 can include one or more elongated lift arms 130 that can be pivotally connected at one end to the machine frame 104 and that are operatively coupled to the rear of the bucket 120 at the other end through a lower bucket pin joint 132 or a revolute joint that defines a lower pivot axis of the bucket 120. A lift actuator 134 is connected to the machine frame 104 of the bucket loader 100 and connects to the lift arms 130 through an lift arm pin joint 136, which may also be a revolute joint. The lift actuator 134 is thus braced between the machine frame 104 and the lift arms 130 such that, when extended and retracted, the lift actuator 134 will pivotally articulate the lift arms 130 raising and lowering the bucket 120 with respect to the work surface 102 between the lowered (loading) and raised (lifted) configurations as depicted in solid lines and dashed lines respectively.

To enable the bucket 120 to alternatively hold or dump material, the bucket 120 is pivotally connected to the lift arms 130 via the lower bucket pin joint 132 so as to be rotatable with respect to the lifting mechanism 122. To rotate or tilt the bucket 120 relative to the lifting mechanism 122, a tilt lever 140 can be rotatably coupled to the lift arms 130 and operatively joined to the rear of the bucket 120 at an upper bucket pin joint 142, which defines an upper pivot axis of the bucket. A tilt actuator 144 is connected at one end of the one or more lift arms 130 and at the other end to the tilt lever 140 to rotate the tilt lever and thereby pivot the bucket 120 about the lower bucket pin joint 132. The bucket 120 thus rotates from a configuration vertically supporting the material accommodated therein to a configuration to dump the material from the bucket. The tilt lever 140 and tilt actuator 144 also enable the bucket 120 to tilt between the forward facing direction to penetrate and dig into material and the racked or hauling position to carry material over the work surface 102 of the worksite.

In an embodiment, the lift actuator 134 and tilt actuator 144 can be linear hydraulic cylinders that can extend and retract under the effect of pressurized fluid from a hydraulic system associated with the wheel loader 100. In other embodiments, the lifting mechanism 122 may utilize cable, pulleys, elevators or other mechanisms to raise and lower the bucket 120 with respect to the work surface 102. In an embodiment, the lower and upper bucket pin joints 132, 142 coupling the rear of the bucket 120 to the lift mechanism 122 can be configured as quick coupling joints so that different styles and types of buckets can be coupled to the lifting mechanism for different operations.

In an embodiment, to accommodate an operator and/or the operator input devices or controls for operation of the machine, the wheel loader 100 can include an onboard operator station 150 disposed in a vertically elevated location to provide a visual overview of the work surface 102 and the wheel loader 100. The operator input devices can be configured for manipulative input to control operational aspects of the wheel loader 100. For example, the operator input devices can include travel inputs 152 that control mobile travel of the wheel loader 100 over the work surface 102 and lift inputs 154 that can manipulate the vertical elevation and configuration of the bucket 120 and the lifting mechanism 122 with respect to the work surface 102. Examples of travel inputs 152 and lift input 154 can include hand wheels, joysticks, pedals, levers, knobs, keypads, etc. The travel input devices 152 can laterally turn the forward and/or rearward sets of the propulsion components 114 to steer the wheel loader 100. The travel inputs 152 can be operatively associated with the governor pedal 156 to increase or decrease the travel velocity of the wheel loader 100 with respect to the travel direction 110 to speedup, slow, and/or stop travel of the wheel loader. The travel inputs 152 can be capable of adjusting and changing the forward, reverse, and neutral travel directions.

To alter the position of the bucket 120, the lift inputs 154 can be controllably associated with the lift and tilt actuators 134, 144 to movably reconfigure the lifting mechanism 122. For example, the lift inputs 154 can be manipulated by an operator to raise the bucket 120 from a lowered position with respect to the work surface 102 for loading material, as indicated in FIG. 1 in solid lines, to a raised position for hauling and/or dumping material, as indicated in FIG. 1 by dashed lines.

To further interface with an operator, the operator station 150 can include an interface device 158, sometimes referred to as a human-machine interface ("HMI"). The interface device 158 can be or include a visual display such as a liquid crystal display that can present visual images or textual renderings to the operator. In various embodiments, the interface device 158 can include or be associated with a graphical user interface. To provide information to the operator, the interface device 158 can display visual readings or indications regarding data like travel speed, performance data regarding the internal combustion engine 116, and load or positioning date regarding the bucket 120 and the lifting mechanism 122. To receive inputs from the operator, the interface device 158 can include touchscreen capabilities or may be associated with a keypad, a mouse, buttons, switches or other inputs.

In accordance with an aspect of the disclosure, and in distinction from onboard operation via the onboard operator station 150 described above, the wheel loader 100 may be configured for remote operation. In remote operation, the operator input devices including the travel inputs 152 and the lift inputs 154 and other controls and informational indicators of the onboard operator station 150 may be located at an off-board operator station 160 located off-board and remote from the wheel loader 100. An operator situated at the off-board operator station 160 can utilizes the travel inputs 152 and lift inputs 154 located there to remotely maneuver the wheel loader 100 through the lifting, hauling, and dumping operation. To establish communication between the wheel loader 100 and the off-board operator station 160 for remote control, the off-board operator station can include an off-board transceiver 162 and the wheel loader can include an onboard transceiver 164. The off-board and onboard transceivers can both transmit and receive information and data through a transmission medium such as through radio frequency communication.

During remote operation, to provide the operator with situational or contextual information about the wheel loader 100 with respect to the work surface 102, the wheel loader may be equipped with an onboard camera system 166 that can include a plurality of onboard cameras or similar visual sensors that capture and transmit visual images from the vantage point of the wheel loader to the off-board operator station 160. Other technologies for providing contextual information to an off-board operator can include LIDAR, radar, and other imaging and ranging methods.

In another aspect of the disclosure, the wheel loader 100 or similar machine can be configured for fully autonomous, semiautonomous, or manual operation. In fully autonomous operation, the machine is operated according to a predetermined work plan without the assistance of a human operator, while in semiautonomous operation, a human operator who may be present on the machine or may be at a remote location may be responsible for directing the machine to perform certain tasks which may be assisted with guidance or partial control from a control system operatively associated with the bucket loader 110. In manual operation, the operator is generally responsible for directing all tasks performed by the machine. Various aspects of autonomous and/or manual operation, such as utilization of an observer to oversee operation of the wheel loader 100, may be conducted remotely via the off-board operator station 160.

To facilitate controlled operation of the wheel loader 100, the wheel loader can be operatively associated with a control system embodied in an electronic controller 170, sometimes referred to as an electronic control module (ECM) or an electronic control unit (ECU). The electronic controller 170 can be a programmable computing device and can include one or more microprocessors 172 for executing software instructions and processing computer readable data. Examples of suitable microprocessors include programmable logic devices such as field programmable gate arrays ("FPGA"), dedicated or customized logic devices such as application specific integrated circuits ("ASIC"), gate arrays, a complex programmable logic device, or any other suitable type of circuitry or microchip. To store application software and data for the perception-based alignment system, the electronic controller 170 can include a non-transitory computer readable and/or writeable memory 174, for example, read only memory ("ROM"), random access memory ("RAM"), EPROM memory, flash memory, or another more permanent storage medium like magnetic or optical storage. To interface and network with other operational systems on the wheel loader 100, the electronic controller 170 can include an input/output interface 176 to electronically send and receive non-transitory data and information. The input/output interface 176 can be physically embodied as data ports, serial ports, parallel ports, USB ports, jacks, and the like to communicate via conductive wires, cables, optical fibers, or other communicative bus systems via any suitable communication protocol such as CAN Bus, WiFi, Bluetooth, or cellular communication standards. The electronic controller 170 may be associated with other software including any suitable instruction sets, programs, applications, routines, libraries, databases and the like, for carrying out its functions. Although in FIG. 1, the electronic controller 170 is illustrated as a single, discrete unit, in other embodiments, the electronic controller 170 and its functions may be distributed among a plurality of distinct and separate components, including various components and functionalities located onboard the wheel loader 100 and at the off-board operator station 160.

Figure 2:
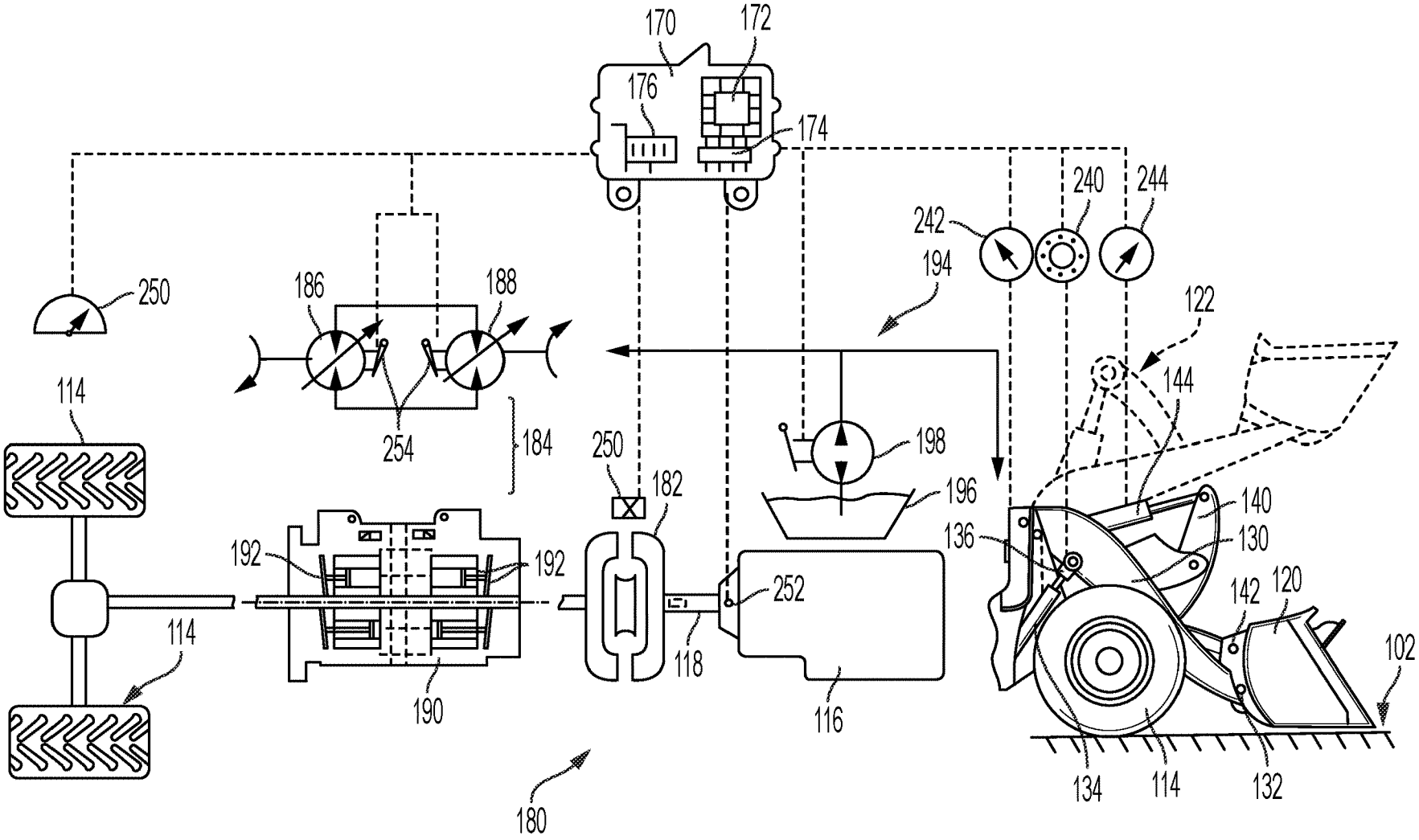
FIG. 2 is a schematic illustration of a lifting mechanism of the wheel loader lowered into a loading configuration to receive material into a bucket.
Figure 3:
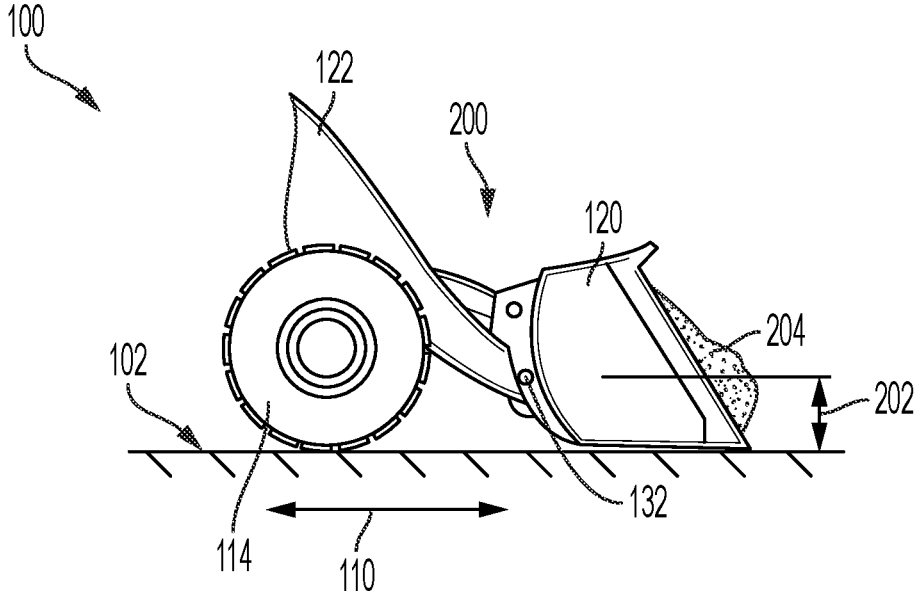
FIG. 3 is a schematic illustration of the lifting mechanism raised into a lifted configuration with the bucket held above the remainder of the wheel loader.

Referring to FIGS. 1 and 2, to adjustably control operation of the wheel loader 100, including maneuvering with respect to the travel direction 110 and vertically positioning of the bucket 120 with respect to the work surface 102, the electronic controller 170 can be operatively associated with a drivetrain 180 that couples the internal combustion engine 116 to the propulsion components 114 and with the lift actuator 134 and the tilt actuator 144 of the lifting mechanism 122. Furthermore, to receive directives from the operator about controllably adjusting these systems, the electronic controller 170 can communicate via digital or analog electronic signals with the travel inputs 152 and the lift inputs 154. The data lines of the electronic communications network between the electronic controller 170 and the systems of the wheel loader 100 including the lifting mechanism 122 and the drivetrain 180 are represented by dashed lines and may be embodied as a CAN bus or similar protocols and may utilize conductive wires or fiber optics as the physical transmission media.

The drivetrain 180 as illustrated in FIG. 2 can include various components that adjustably control and regulate aspects of travel of the wheel loader 100 with respect to the work surface 102 such as, for example, travel velocity and direction along the travel axis 110. In an embodiment, the drivetrain 180 may include a torque convertor 182 that is directly coupled to the crankshaft 118 extending from the internal combustion engine 116. The torque converter 182 can be a fluid coupling that transfers rotating power from the engine 116 through the rest of the drivetrain 180 to the propulsion components 114 associated with the load on the wheel loader 100. In an embodiment, the torque converter 182 can include an impeller coupled to the internal combustion engine 116, a turbine coupled to the remainder of the drivetrain 180, and a stator that can redirect fluid flow within the torque converter 182 based on the output speed or load applied to the turbine. The torque converter 182 can increase and decrease the torque transmitted from the internal combustion engine 116 in relation to travel velocity produced by the propulsion components 114. Moreover, the torque converter 180 can decouple the internal combustion engine 116 from the propulsion components 114, for example, if the wheel loader 100 is in neutral and stopped or not moving with respect to the work surface 102.

To further adjust the speed and or torque produced by the internal combustion engine 116, the drivetrain 180 can include a transmission and, in a particular embodiment, a hydrostatic transmission 184. The hydrostatic transmission 184 can include a variable displacement hydraulic pump 186 that is fluidly coupled to a variable displacement hydraulic motor 188 using hydraulic fluid directed through suitably arranged fluid conducts that may form a closed fluid circuit. Adjusting the fluid displacement of the hydraulic pump 186 and thus the volume of fluid flowing in the hydraulic circuit results in a corresponding change in speed and/or torque output of the hydraulic motor 188. The hydraulic transmission 184 can thereby adjust operation of the drivetrain 180 over a variable range of speed-torque ratios. To physically change fluid displacement, the hydraulic transmission 184 can include a housing 190 that accommodates a pair of swashplates 192 associated with the hydraulic pump 186 and the hydraulic motor 188. The swashplate 192 can be a circular disk mounted to a shaft at an adjustable angle such that, by varying the angle, rotational motion of the shaft is converted to linear or translational motion that in turn can pump hydraulic fluid from the hydraulic pump 186 to the hydraulic motor 188.

In an embodiment, the drivetrain 180 can be selectively set in different drivetrain modes to conform to the operating conditions and operator preferences. For example, a hydrostat mode may enable direct operator control of the drivetrain performance through the governor pedal 156 in the onboard operator station 150. In a torque convertor mode, the drivetrain 180 may operate with the characteristics of a conventional torque-converter drivetrain allowing the wheel loader 100 to coast when the operator releases the governor pedal. An ice control mode may configure the drivetrain 180 to deliver power to the propulsion components 114 with sensitivity to slippage conditions such as operation on ice.

To adjustably control the lifting mechanism 122 coupled to the bucket 120, the wheel loader 100 can be operatively associated with a hydraulic system 194 that supplies pressurized hydraulic fluid to the lift actuator 134 and the tilt actuator 144. The hydraulic system 194 can include a tank or reservoir 196 to accommodate hydraulic fluid and a hydraulic pump 198 that can pressurize and direct hydraulic fluid to the lift and tilt actuators 134, 144. The hydraulic pump 198 may also be a variable displacement pump to adjust the flow volume and pressure of the hydraulic fluid directed to the actuators. Moreover, the hydraulic system 194 can include one or more flow control or directional control valves to change fluid flow and hydraulic pressure within the hydraulic system. Accordingly, extension and retraction of the lift and tilt actuators 134, 144 associated with vertical displacement of the bucket 120 with respect to the work surface 102 can be adjustably controlled and thus the lifting mechanism 122 can selectively maneuver the bucket 120 through various operational and sequential motions, positions, and configurations.

Referring to FIGS. 3-6, there is illustrated a possible sequence of maneuvers that the bucket 120 and the lifting mechanism 122 may conduct or be maneuvered through during a loading, hauling, and dumping operation. In accordance with the disclosure, these maneuvers may be performed manually by an operator onboard the wheel loader 100, an operator located remotely from the wheel loader, or may be performed semi-autonomously or fully autonomously. To initially receive material into the bucket 120, referring to FIG. 3, the lifting mechanism 122 can be vertically lowered so that the bucket 120 is proximate to the work surface 102. Furthermore, the bucket 120 can be tilted with respect to the lifting mechanism 122 so that the leading edge or blade 124 is parallel and adjacent to the work surface 102. The position of the bucket 120 vertically proximate to the work surface 102 can be referred to as a lowered or loading configuration 200 or position, and in such a configuration, the lower bucket pin joint 132 that links the bucket 120 to the lifting mechanism 122 may only be several centimeters above the work surface 102, as indicated by the arrow referred to as the lowered or loading vertical height or distance 202. With the bucket 120 in the loading configuration 200, the wheel loader 100 can be moved forward with respect to the travel direction 110 so that the bucket penetrates or crowds into the material 204, which may be deposited in a pile.

Figure 4:
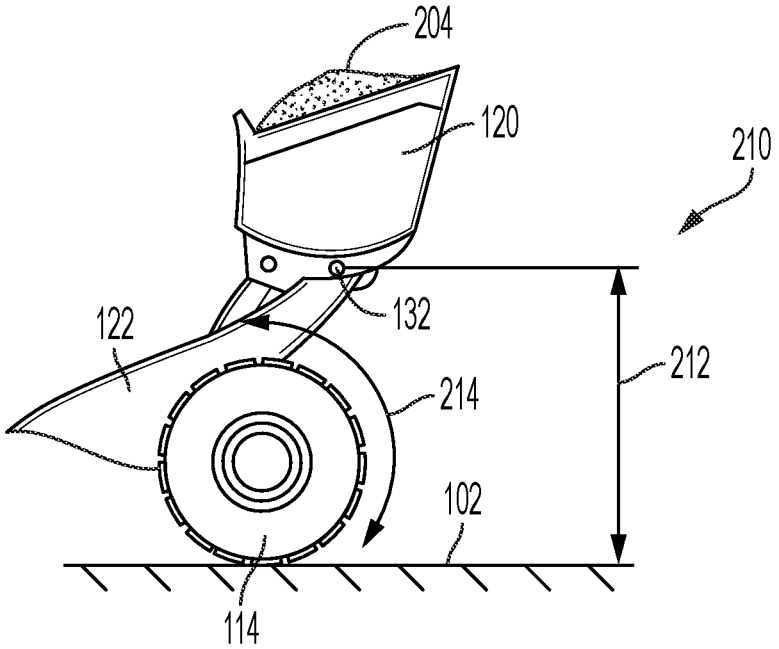
FIG. 4 is a schematic illustration of the lifting mechanism raised into a hauling configuration to haul material in the bucket about the worksite.
Figure 5:
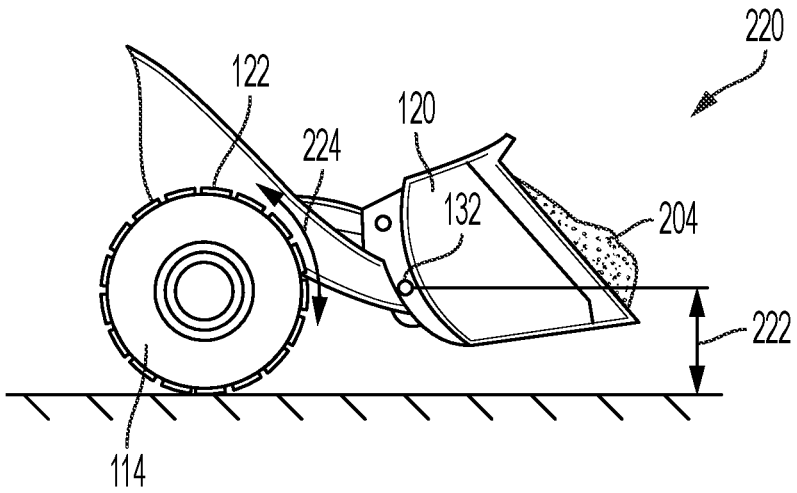
FIG. 5 is a schematic illustration of the lifting mechanism in a dump configuration to dump material from the bucket.

To continue filling the bucket 120 with material 204, referring to FIG. 4, the wheel loader 100 can be moved further forward with respect to the travel direction 110 while the lifting mechanism 122 articulates to raise the bucket 120 through material that may be piled on the work surface 102. The lifting mechanism 122 may be vertically articulated to a raised or lifted configuration 210 at such an extent that the bucket 120 from the reference of lower bucket pin joint 132 is vertically located a considerable height above the rest of the wheel loader 100. This raised or lifted vertical distance 210 may result in the lower bucket pin joint 132 being several meters above the work surface 102, as indicated by the lifted vertical height or distance 212.

In the lifted configuration 210, the balance of the wheel loader 100 with respect to the work surface 102 may become considerably unstable. For example, the relative position of the bucket 120 with respect to the wheel loader 100, and the mass of the bucket and any material therein, can create or generate considerable angular moments, indicated by arrow 214, about the forward propulsion components 114. In particular, the load associated with the bucket 120 and material therein and the relative location and distance of the bucket 120 with respect to the forward propulsion component 114 due to the length of the lifting mechanism 122 may attempt to tilt or tip the wheel loader 100 about the forward propulsion unit 114. In other words, the rearward end of the machine frame may tend to tilt or jump upwards with respect to the forward end.

To avoid this unstable arrangement, operators are trained to vertically articulate the lifting mechanism 122 and lower the bucket 120 to a more stable position prior to travel or hauling the material over the work surface 102. For example, this may be an intermediate or travel configuration 220 illustrated in FIG. 5 wherein the bucket 120, from the reference point of the lower bucket pin joint 132, is at an intermediate vertical distance 222 above the work surface 102, which may be on the order of a meter. The travel configuration 220 of the bucket 120 reduces the moment generated about the forward propulsion unit 114, as indicated by arrow 224, and stabilizes the wheel loader 100. The wheel loader 100 can travel about the worksite at considerable speeds without the hazards of instability and tilting over associated with the lifted configuration 210 of the bucket 120, and is therefore also more resistant to instability resulting from inclines or unevenness of the work surface 102 during travel.

Figure 6:
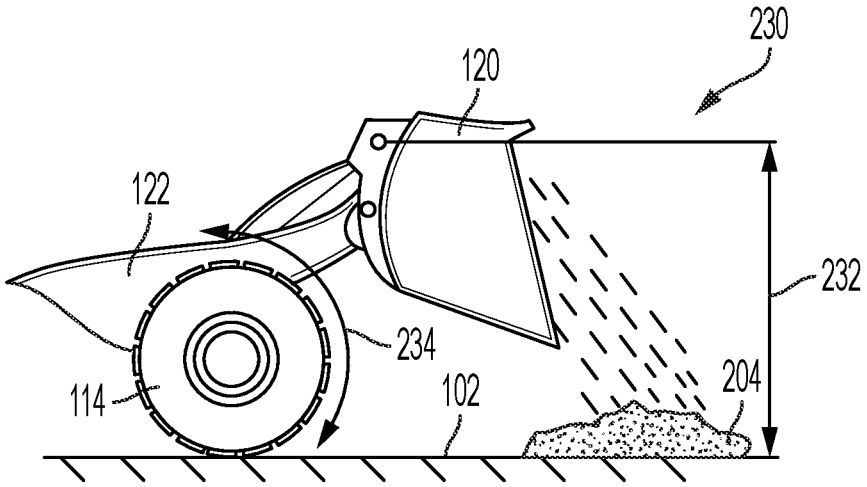
FIG. 6 is a schematic illustration of a drivetrain and a control system that may be associated with the wheel loader to enable operation in at least two modes of performance including a rated performance mode and a limited performance mode.

To deposit material 204, the lift mechanism 122 can again be vertically articulated to raise the bucket 120 to a dump configuration 230, illustrated in FIG. 6. In the dump configuration 230, the bucket 120 is raised to a dumping vertical distance 232 in which the lower bucket pin joint 132 is again several meters above the work surface 102. For the reasons described, the dump configuration 230 can cause or generated moments about the forward propulsion component 114 as indicated by arrow 234 resulting in instability of the wheel loader. Accordingly, when the bucket 120 and lifting mechanism 122 are in the dump position 230, the operators may be trained to avoid moving the wheel loader forward or rearward in the travel direction 110 to prevent tilting or tipping.

Thus, the stability and balance of the wheel loader is negatively impacted when the bucket 120 and lifting mechanism 122 are vertically articulated to the lifted and dump configuration 210, 230. This may be compounded in situations where the wheel loader 100 is remotely controlled from an off-board operator station 160 because the sensory feedback available to the remote operator is reduce or eliminated. For example, if the operator was situated in the onboard operator station 150, they would be able to directly sense the unstable balance of the wheel loader 100 with the bucket 120 in the lifted configuration 210 or in the dump configuration 230 and would be able to take remedial action such as slowing the travel velocity. In another situation, where the operator is relatively inexperienced, they may not have developed the initiate sensory skill to assess the unbalanced condition of the wheel loader 100 and are unable to take remedial or preventative adjustments in operation of the wheel loader.

To avoid or mitigate against the possibility of the wheel loader 100 becoming unstable, especially when operated remotely or by less experience operators, the electronic controller 170 can be configured to jointly regulate and adjust operation of the lifting mechanism 122 coupled to the bucket 120 in cooperative conjunction with the performance capabilities of, for example, the drivetrain 180. The electronic controller 170 may be operatively associated with and in electronic communication with a plurality or network of sensors and controls associated with the components of the lifting mechanism 122 and the drivetrain 180 to facilitate adjustment and dependent control of these systems. For example, to sense or measure the present vertical height or distance of the bucket 120 with respect to the work surface 102, a rotary sensor 240 or rotary encoder may be coupled to the lift arm pin joint 136 which connects the lift arm 130 with the lift actuator 134. When the lift actuator 134 extends and retracts, the rotary sensor 240 can measure the angular displacement or change of the lift arm pin joint 136 which, based on predetermined dimensions and kinematics of the lifting mechanism 122, can be converted to determine the present vertical height or distance of the bucket 120, including if the bucket is in one of loading, lifted, travel, or dump configurations described above.

To determine the mass or weight of the bucket 120 and lifting mechanism 122, especially as it relates to angular moments generated with respect to the wheel loader 100, the electronic controller 170 can also communicate with a pressure sensor 242 associated with the lift cylinder 134. The pressure sensor 242 can measure the hydraulic pressure in the lift actuator 134 which, based on its value, indicates if the bucket 120 is loaded with material and possibly the effect of the mass on the angular moments created about the wheel loader 100. The electronic controller 170 may also communicate with a sensor associated with the tilt actuator 144 for example, a second pressure sensor 244, to determine the angular orientation of the bucket 120 with respect to the lifting mechanism 122 to determine if the bucket 120 is presently oriented to load, haul, or dump material.

To determine the present travel velocity or speed of the wheel loader 100 over the work surface 102, the electronic controller 170 can be in communication with a speed sensor 250 operatively associated with the propulsion devices 114. The speed sensor 250 may be a magnetic pickup sensor, a relative rotational sensor, or utilize other suitable technology that measures rotation of the propulsion components 114, in RPM for example, which can be converted to the ground speed or travel velocity of the wheel loader 100. In an embodiment, the speed sensor 250 can also be configured to measure other variables associated with the propulsion devices such as, for example, rim pull torque. In an embodiment, the electronic controller 170 can also communicate with an engine speed sensor 252 to measure the output speed of the internal combustion engine 116.

To controllably adjust the speed of the propulsion components 114, and thus the travel velocity of the wheel loader 100 with respect to the work surface 102, the electronic controller 170 can be operatively associated with one or more velocity controls. For example, in the embodiment where the drivetrain 180 includes a hydrostatic transmission 184, the electronic controller 170 can communicate with flow control actuators 254 operatively associated with the hydraulic pump 186 and/or the hydraulic motor 188. In the example where the hydraulic pump 186 and hydraulic motor 188 are variable displacement devices, the flow control actuators 254 change and control the flow of hydraulic fluid between the pump and motor to adjust the input-to-out speed ratio thought the hydraulic transmission 184. In a further embodiment, the electronic controller 170 can also communicate with a torque converter control 256 to direct operation of the torque converter 182 including varying the input-output ratios of speed and torque.

The electronic controller 170 may also communicate with various device to facilitate remote or autonomous operation. For example, the electronic controller can be communicatively coupled with the onboard transceiver 164 so that the electronic controller can receive and process command signals from the off-board operator station. The electronic controller 170 is therefore responsible for the onboard activities associate with remote operation. The electronic controller 170 can also communicate with the onboard camera system 166 to process and interpret the captured images before relaying them to the off-board operator station.

INDUSTRIAL APPLICABILITY

To enable the electronic controller 170 to utilize the network of sensors and controls to reduce the likelihood of the wheel loader 100 becoming unstable due to the configuration of the bucket 120 and lifting mechanism 122 relative to the work surface 102, the electronic controller 170 can be programmed with a performance management system 300 that limits the performance capabilities of the wheel loader in relation to vertical articulation of the bucket and lifting mechanism. In particular, the performance management system 300 may determine whether to operate the wheel loader 100 under two or more performance modes that determine or set the performance characteristics or capabilities of various systems and features of the wheel loader 100. The performance modes may include a rated performance mode 302 if stability of the wheel loader 100 is not an issue and a limited performance mode 304 if stability of the wheel loader 100 may be problematic.

Figure 7:
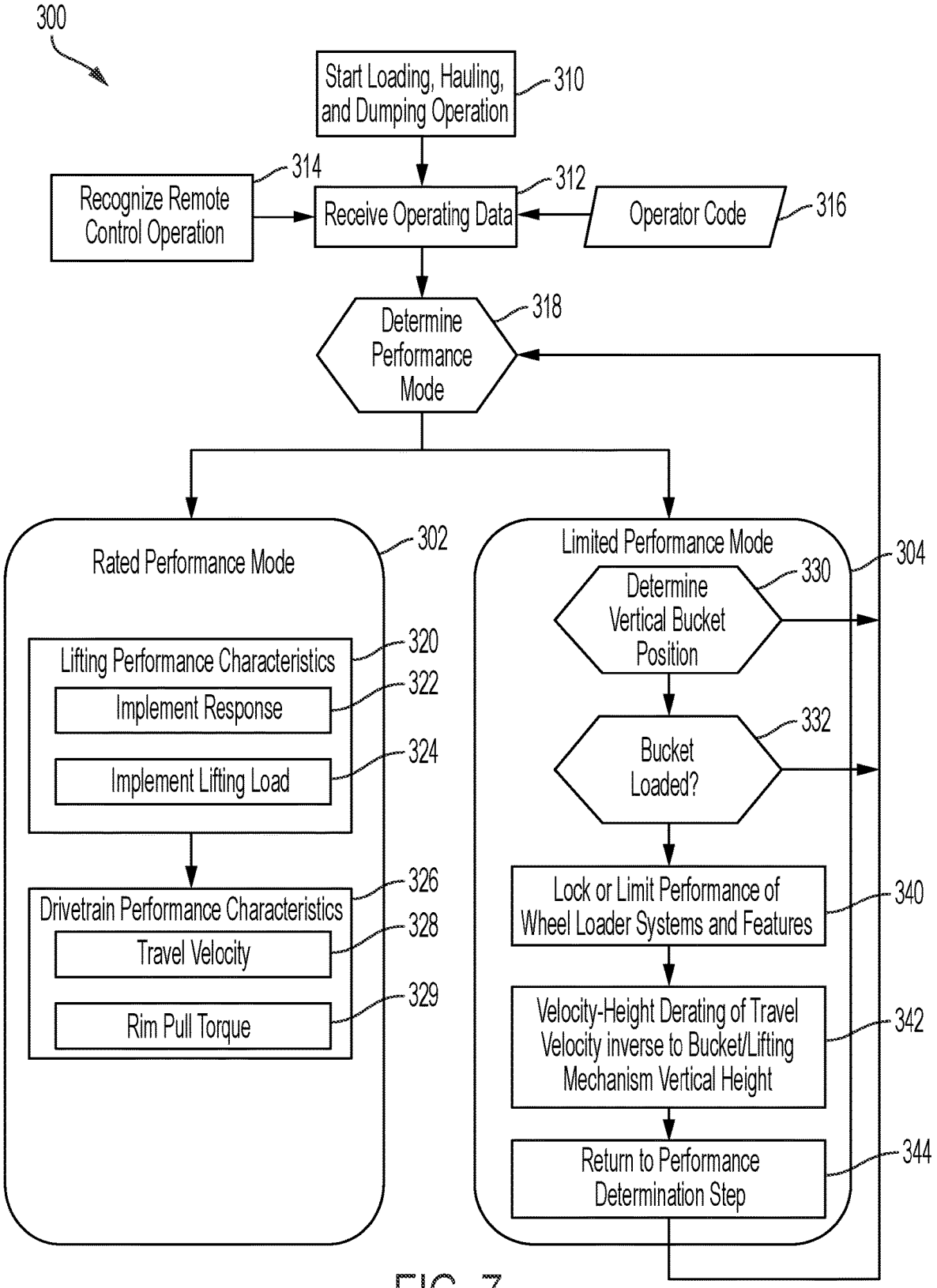
FIG. 7 is an exemplary flow diagram of a performance management system for selecting operation between different performance modes of the wheel loader based on performance selection inputs.

Referring to FIG. 7 and in general accordance with the prior figures, there is illustrated an exemplary process that may be executed by performance management system 300. The process depicted in the flow diagram for accomplishing these tasks may include a series of steps or instructions implemented as non-transitory computer executable software code in the form of an application or program. In an initial starting step 310, the wheel loader 100 may begin a loading, hauling and dumping operation to load, move and distribute material about a worksite. Concurrently with the start of the loading operation 310, the performance management system 300 may determine which of the two operational performance modes is appropriate based on, for example, whether the wheel loader 100 is being controller remotely, autonomously, or due to the skill level of the operator.

This determination can be accomplished in various ways though an operating data collection step 312 in which one or more performance selection inputs are collect and assessed. The performance selection inputs may be data indicating that operation of the wheel loader 100 may result in instability of the wheel loader and thus that limiting or reducing the available performance capabilities of the wheel loader is appropriate. For example, in the event of remote operation, the electronic controller 170 that may be receiving and processing command signals through the onboard transceiver 164 from the off-board operator station 162 may determine, in a remote recognition step 314 via appropriate logic, that the wheel loader 100 is under remote control. In the embodiment where the skill level of the operator is the determining factor, the operator may input an operator code 316 identifying the operator to the electronic controller 170. The operator code 316 may be associated with or encode the training level and the number of operating hours the operator has.

The performance selection inputs including the remote recognition step 314 and/or the operator code 316 and possibly others received by the operating data collection step 312 are directed to and processed by a mode determination step 318 which determines whether the performance management system 300 should operate the wheel loader 100 under the rated performance mode 302 or the limited performance mode 304. If the mode determination step 318 determines the rated performance mode 302 is appropriate, for example, because the wheel loader is not being operated remotely or autonomously, or because the operator has sufficient experience, and thus the wheel loader 100 is not prone to becoming unstable during operation, the performance management system 300 enters the rated performance mode 302. The rated performance mode 302 makes available to the operator the full manufacturer-rated capabilities and performance characteristics of the wheel loader 100. For example, with respect to the lifting mechanism 122, lifting performance characteristics 320 such as implement response 322 and implement load 324 are fully available. With respect to the drivetrain 180, drivetrain performance characteristics 326 such as travel speed 328 and output torque 329 are also fully available.

If the mode determination step 318 determines that unstable operation of the wheel loader 100 is likely based on the performance selection inputs, for example, because of remote or autonomous operation or because of the skill level of the operator, the mode determination step 318 can select the limited performance mode 304. In the limited performance mode 304, the performance characteristics available during operation the wheel loader 100 may be limited or derated from the manufacturer-rated capabilities and performance characteristics based on, for example, the vertical height of the bucket 120 and the lifting mechanism 122 with respect to the work surface 102. The performance management system 300 may implement the limited performance mode 304 in various ways.

For example, the limited performance mode 304 can determine whether the present operating conditions of the wheel loader 100 necessitate limiting or derating the performance capabilities of the wheel loader due to an unstable condition resulting from the vertical position or configuration of the bucket 120 and lifting mechanism 122. To determine the present position of the bucket 120 and lifting mechanism 122 with respect to work surface 102, the limited performance mode 304 can include a vertical determination step 330. For example, sensed data regarding the vertical articulation of the lifting mechanism 122 with respect to the machine frame 104 can be received by the vertical determination step 330. In an embodiment, the sense data can be provided from the rotary sensor 240 coupled to the lift arm pin joint 136 which indicates the angular articulation of the lifting mechanism 122 with respect to the machine frame 104. Using predetermined dimensions and kinematics associated with the lifting mechanism 122, the electronic controller 170 can covert the angular articulation to the vertical distance or position of the bucket 120 with respect to the work surface 102. The vertical distance or position may be determined with respect to a reference point on the bucket, for example, the lower bucket pin joint 132.

If the vertical determination step 330 determines the bucket 120 is in sufficiently close proximity to the work surface 120 that machine stability is not an issue, the performance management system 300 may conclude that performance characteristics of the wheel load do not need to be limited and return to the mode determination step 318 to continue monitoring operation of the wheel loader 100. If the vertical determination step 330 does conclude that the bucket 120 is articulated or raised to vertical distance above the work surface 102 that machine stability is a concern, the performance management system 300 can continue with the limited performance mode 304 to undertake appropriate measures.

In an embodiment, the performance management system 300 can include a load determination step 332 to determine the quantity of material that may be received in the bucket 120, and thus the force of any resulting angular moment applied to the wheel loader 100. By way of example, the load determination step 332 can be conducted with the first pressure sensor 242 associated with the lift actuator 134 and/or the second pressure sensor 244 associated with the tilt actuator 144. The hydraulic pressure in the actuators may be proportional to the quantity of material accommodated in the bucket 120 and can thus be converted to determine the applied load. If, for example, the bucket 120 is empty, the angular moments generated may be sufficiently small and the risk of instability diminished even if the lifting implement 122 is vertically articulated into the lifted configuration. The performance management system 300 can exit the limited performance mode 304 and return to the mode determination step 318 where it may enter the rate performance mode 302. If, however, the load in the bucket 120 generates a significant angular moment, the limited performance mode 304 may continue steps to limited the manufacturer-rated performance of the wheel loader 100.

For example, the limited performance mode 304 may include a performance lock or limitation step 340 under which the functionality or performance characteristics associated with various systems and features of the wheel loader 100 are locked or limited. If system or feature is locked, it is unavailable during operation of the wheel loader 100 and, if the system or feature is limited, the available performance characteristics or capabilities may be reduced from the manufacturer-rated performance characteristics. By way of example only, and not as limitation, the following table indicates some systems or features associated with operation of a wheel loader 100 that may be locked or limited by the performance lock or limitation step 340:

| FEATURE | SETTING |
|---|---|
| Travel Velocity Forward | 10 kilometers per hour (Kph) |
| Travel Velocity Reverse | 10 kilometers per hour (Kph) |
| Lifting Mechanism Response | Low |
| Drivetrain Mode | Hydrostatic |
| Hydrostatic Transmission Response | Medium |

In another embodiment, the limited performance mode 304 may include a velocity-height derating step 342. In particular, to avoid unintentionally tilting or tipping the unstable wheel loader 100, the velocity-height derating step 342 may limit or derate the available travel velocity of the wheel loader in proportion to the vertical height of the bucket 120 coupled to the lifting mechanism 122. For example, after loading with material, if the bucket 120 and lifting mechanism 122 are not moved from the lifted configuration 210 in FIG. 4 to the travel configuration 220 in FIG. 4, the travel speed of the wheel loader will be limited and may not increase above a predetermined amount to improve stability. Likewise, if the bucket 120 and lifting mechanism 122 are moved into the dumping configuration 230 of FIG. 6 while the wheel loader 100 is traveling too quickly, the velocity-height derating step 342 may automatically slow the wheel loader to increase stability.

To limit the travel velocity in the velocity-height derating step 342, the electronic controller 170 can adjust various components of the drivetrain 180 in FIG. 2 to reduce the rotational output speed between the internal combustion engine 116 and the propulsion components 114. For example, the electronic controller 170 can regulate operation of the hydrostatic transmission 184 to adjust the hydrostatic fluid flow between the hydraulic pump 186 and the hydraulic motor 188. In the embodiment of the hydrostatic transmission 184 including swashplates 192, the angular orientation of the swashplates accommodated in the housing 190 can be changed to reduce or restrict hydraulic fluid flow. In other embodiments, the electronic controller 180 can adjust operation of the torque converter 182 or adjust brakes operatively associated with the plurality of propulsion components 114.

Figure 8:
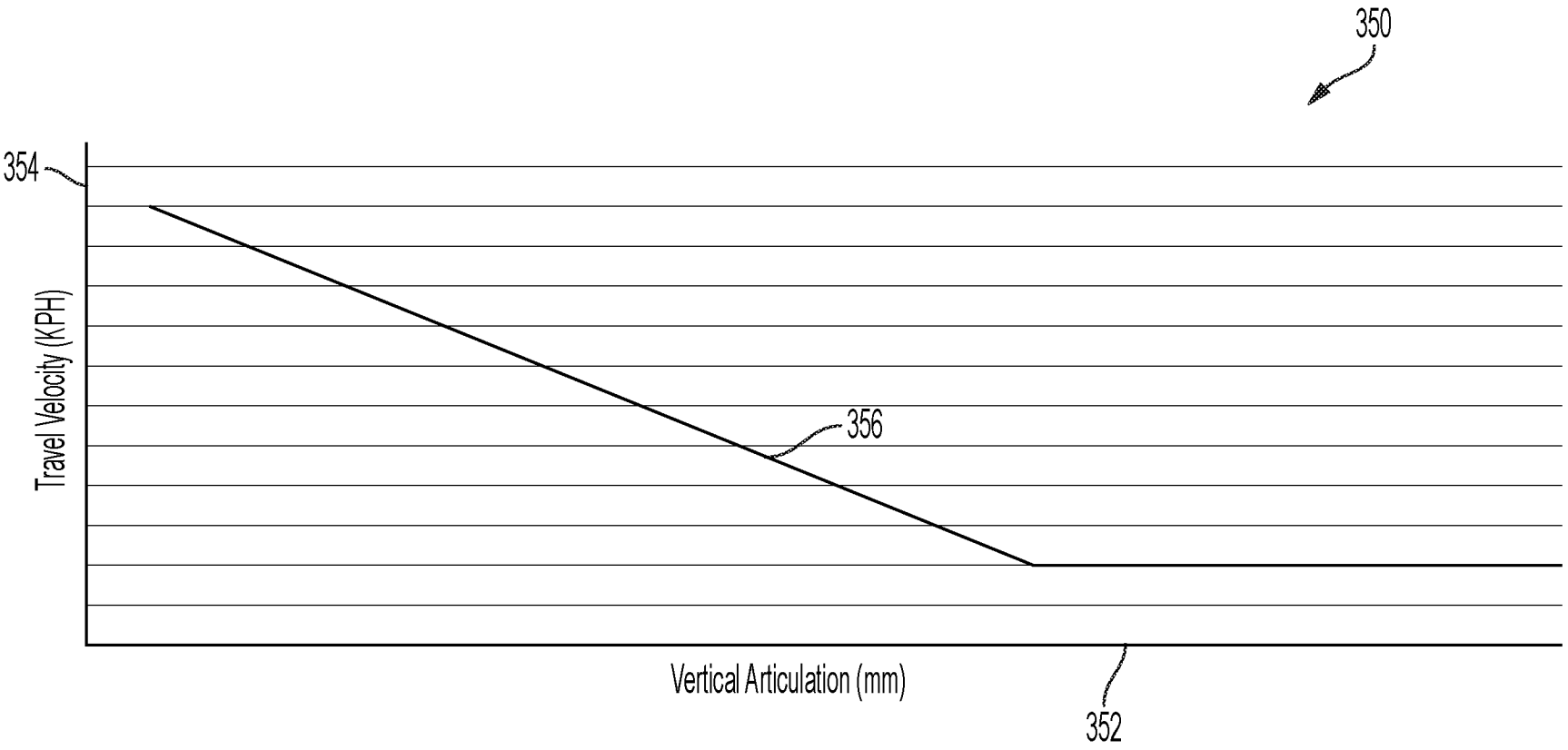
FIG. 8 is a chart illustrating an inverse relation between vertical articulation of the lifting implement and the available travel velocity of the wheel loader to reduce or element instability during operation.

In an embodiment, the velocity-height derating step 342 may include or be based upon an inversely proportional relation between the vertical position of the bucket 120 and lifting mechanism 122 and the available velocity of the wheel loader 100. For example, FIG. 8 illustrates a chart 350 of the inverse relation between the vertical position of the bucket and lift arm on the X axis 352 and the available travel velocity on the Y-axis 354. The plotted line 356 shows that these two variable are inversely related with, for example, an increase in vertical configuration of the bucket 120 and lifting mechanism 122 causing a decrease in available travel velocity 354. Moreover, as indicate, the inverse relation between the vertical articulation of the bucket and lifting mechanism and the available travel velocity may be linear and proportional. The chart represented in FIG. 8 can be programed as a data table or data structure stored in the electronic controller 170 and accessible by the performance management system 300.

In various embodiments, the limited performance mode 304 may include both or either of the performance lock or limitation step 340 and the velocity-height derating step 342 and may occur in any order. In a concluding return step 360, the performance management system 300 can return to the mode determination step 318 to determine whether to continue operation of the wheel loader under either the rated performance mode 302 or the limited performance mode 304 is appropriate for the current prevailing conditions.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A loading machine comprising:

a machine frame supported on a plurality of propulsion components for travel over a work surface;

a power source operatively coupled to the plurality of propulsion components through a drivetrain to propel the loading machine, the power source and drivetrain being selectively adjustable to change a travel velocity of the loading machine over the work surface;

a lifting mechanism articulately coupled to the machine frame and operatively associated with a lift actuator to articulate the lifting mechanism with respect to the machine frame;

a lift sensor operatively configured to sense a vertical articulation of the lifting mechanism with respect to the work surface;

a performance selection input enabling selection between at least one of a rated performance mode and a limited performance mode; and an electronic controller operatively associated with the power source and drivetrain and in electronic communication with the lift sensor, the electronic controller being programmed to execute the limited performance mode and limit a travel velocity of the loading machine in dependence on the vertical articulation of the lifting implement with respect to the work surface, wherein the electronic controller is further programmed to limit the travel velocity of the loading machine inversely to the vertical articulation of the lifting implement with respect to the machine frame.

2. The loading machine of claim 1, wherein the electronic controller limits the travel velocity in a linear and proportional relation to vertical articulation of the lifting implement with respect to the machine frame.

3. The loading machine of claim 2, wherein the powertrain includes a hydrostatic transmission and the electronic controller limits the travel velocity through the hydrostatic transmission.

4. The loading machine of claim 3, wherein the hydrostatic transmission includes a swashplate and the travel velocity is limited by angularly adjusting the swashplate.

5. The loading machine of claim 1, wherein the loading machine is configured for remote operation from an off-board operator control station and the performance selection input is indicative of remote-control operation.

6. The loading machine of claim 1, wherein the loading machine is configured for operator control, and the performance selection input is an operator code indicative of a skill level of an operator.

7. The loading machine of claim 1, wherein the electronic controller does not limit the travel velocity in the rated performance mode.

8. The loading machine of claim 1, further comprising a bucket operatively coupled to a distal end of the lifting mechanism.

9. The loading machine of claim 8, wherein the lifting mechanism is vertically articulated between a loading configuration with the bucket proximate the work surface, a lifted configuration with the bucket lifted vertically above the machine frame, and a travel configuration with bucket located between where the bucket is located in the loading configuration and the lifted configuration.

10. The loading machine of claim 9, wherein the lift sensor is a rotary sensor operatively coupled to a lift arm pin joint joining the lifting mechanism to the machine frame.

11. A method for operating a loading machine, the method comprising:

receiving a performance selection input enabling selection between at least one of a rated performance mode and a limited performance mode;

sensing a vertical articulation of a lifting implement with respect to a machine frame to which the lifting implement is pivotally coupled;

converting the vertical articulation of the lifting implement with respect to the machine frame to a vertical distance between a work tool coupled to the lifting implement and a work surface;

limiting a manufacturer-rated performance characteristic of the loading machine in dependence on the vertical distance between the work tool and the work surface in the limited performance mode; and not limiting the manufacturer-rated performance characteristic in the rated performance mode, wherein the manufacturer-rated performance characteristic is a travel velocity of the wheel loader, and wherein the travel velocity is limited inversely to the vertical distance between the work tool and the work surface.

12. The method of claim 11, wherein the travel velocity is limited by angularly adjusting a swashplate of a hydraulic transmission transmitting power between a power source of the loading machine and a propulsion device of the loading machine.

13. The method of claim 12, wherein the performance selection input is indicative of remote-control operation of the loading machine.

14. The method of claim 12, wherein the performance selection input is an operator code indicative of a skill level of an operator of the machine.

15. The method of claim 11, wherein the travel velocity is limited in a linear and proportional relation to the vertical distance between the work tool and the work surface.

16. A performance management system for selecting performance modes for operation of a loading machine, the performance management system comprising:

a lift sensor operatively configured to sense a vertical articulation of a lifting mechanism with respect to a work surface;

a drivetrain configured to transmit power from a power source to a propulsion component to propel the loading machine over the work surface; and an electronic controller in communication with the lift sensor and operatively coupled to the drive train, the electronic controller being programmed to adjust operation of the drivetrain to limit an available travel velocity of the wheel loader in dependence upon on the vertical articulation of the lifting implement with respect to the work surface, wherein the electronic controller is further configured to limit the available travel velocity inversely to the vertical articulation of the lifting implement with respect to the work surface, according to a linear and proportional relationship between the available travel velocity and the vertical articulation of the lifting implement with respect to the work surface.

* * * * *